US006765497B2

(12) United States Patent
Ablay et al.

(10) Patent No.: US 6,765,497 B2
(45) **Date of Patent: *Jul. 20, 2004**

(54) METHOD FOR REMOTELY ACCESSING VEHICLE SYSTEM INFORMATION AND USER INFORMATION IN A VEHICLE

(75) Inventors: Sewim F. Ablay, West Dundee, IL (US); Mark A. Gannon, Sleepy Hollow, IL (US); Ron G. Akers, Palatine, IL (US); Bryan A. Thale, Schaumburg, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/740,549

(22) Filed: Dec. 18, 2000

(65) Prior Publication Data

US 2002/0075168 A1 Jun. 20, 2002

(51) Int. Cl.[7] ..... G08G 1/09

(52) U.S. Cl. ..... 340/905; 380/2; 380/270; 380/273; 713/168; 713/169; 713/190; 713/200

(58) Field of Search ..... 310/905; 380/2, 380/270, 272; 713/168, 169, 190, 200

(56) References Cited

U.S. PATENT DOCUMENTS

| | | | | |
|---|---|---|---|---|
| 5,157,610 | A | | 10/1992 | Asano et al. |
| 5,278,548 | A | | 1/1994 | Haber et al. |
| 5,479,157 | A | | 12/1995 | Suman et al. |
| 5,602,918 | A | | 2/1997 | Chen et al. |
| 5,619,412 | A | | 4/1997 | Hapka |
| 5,627,529 | A | | 5/1997 | Duckworth et al. |
| 5,673,017 | A | | 9/1997 | Dery et al. |
| 5,682,133 | A | * | 10/1997 | Johnson et al. ..... 340/426 |
| 5,731,785 | A | * | 3/1998 | Lemelson et al. ..... 342/357 |
| 5,787,367 | A | | 7/1998 | Berra |
| 5,838,251 | A | | 11/1998 | Brinkmeyer et al. |
| 5,884,202 | A | | 3/1999 | Arjomand |
| 5,884,210 | A | | 3/1999 | Rettig et al. |
| 5,884,211 | A | | 3/1999 | Pauli et al. |
| 5,970,416 | A | | 10/1999 | Ablay et al. |
| 6,275,585 | B1 | | 8/2001 | Ablay et al. |
| 6,351,703 | B1 | * | 2/2002 | Avery, Jr. ..... 701/112 |
| 6,600,734 | B1 | * | 7/2003 | Gernert et al. ..... 370/352 |
| 2002/0065698 | A1 | * | 5/2002 | Schick et al. |

FOREIGN PATENT DOCUMENTS

| | | |
|---|---|---|
| EP | 0 788 946 A2 | 8/1997 |
| WO | WO 97/26750 A1 | 7/1997 |
| WO | WO 98/25248 A1 | 6/1998 |

* cited by examiner

*Primary Examiner*—Julie Lieu
(74) *Attorney, Agent, or Firm*—Thomas V. Miller; Brian M. Mancini

(57) ABSTRACT

A communication system includes a vehicle (101) and an infrastructure (160). The vehicle contains vehicle system information (104) and user information (112). The infrastructure includes a processor (154) with an applications program (155). The application is arranged to remotely access (200, 300, 400 and 500) the vehicle system information in a secure manner. The application is also arranged to remotely access (600) the user information in a secure manner.

19 Claims, 6 Drawing Sheets

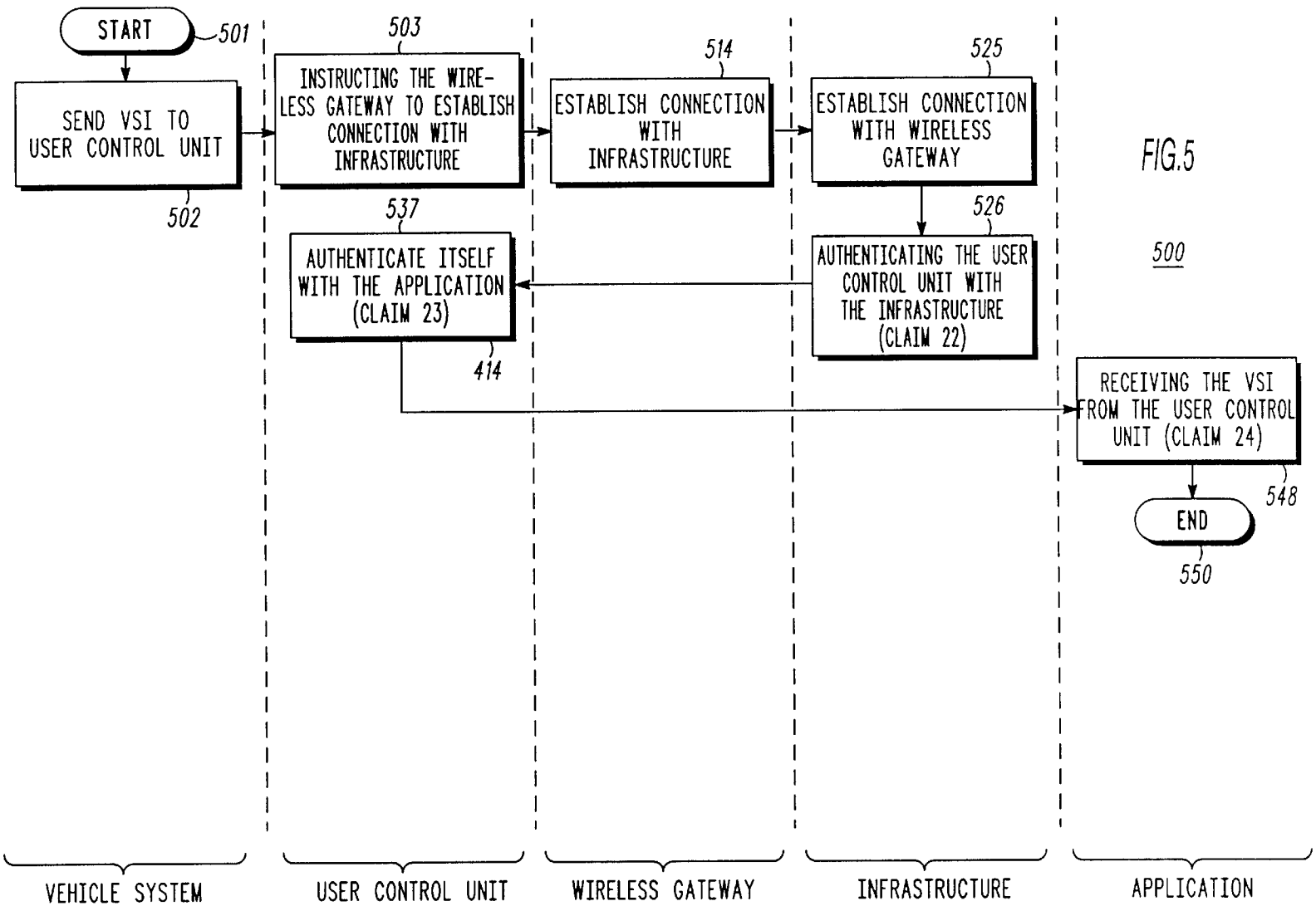
FIG.5
500
START
501
SEND VSI TO USER CONTROL UNIT
502
INSTRUCTING THE WIRE-LESS GATEWAY TO ESTABLISH CONNECTION WITH INFRASTRUCTURE
503
ESTABLISH CONNECTION WITH INFRASTRUCTURE
514
ESTABLISH CONNECTION WITH WIRELESS GATEWAY
525
AUTHENTICATE ITSELF WITH THE APPLICATION (CLAIM 23)
537
414
AUTHENTICATING THE USER CONTROL UNIT WITH THE INFRASTRUCTURE (CLAIM 22)
526
RECEIVING THE VSI FROM THE USER CONTROL UNIT (CLAIM 24)
548
END
550
VEHICLE SYSTEM
USER CONTROL UNIT
WIRELESS GATEWAY
INFRASTRUCTURE
APPLICATION

METHOD FOR REMOTELY ACCESSING VEHICLE SYSTEM INFORMATION AND USER INFORMATION IN A VEHICLE

FIELD OF THE INVENTION

This application relates to telematics including, but not limited to, a method for remotely accessing vehicle system information and user information in a vehicle.

BACKGROUND OF THE INVENTION

It is known for a vehicle, such as a car, to have both a vehicle bus and a user bus, the vehicle bus and the user bus being coupled by means of a vehicle gateway.

As known, typically the vehicle bus supports the various vehicle systems, such as a motive power source (such as, for example, an internal combustion engine, electric engine, or other source of motive power that might be developed in the future), instrument display, door locks, flashing lights, etc. Such vehicle subsystems generate or store vehicle system information pertinent to the vehicle or its occupants. Such vehicle system information typically consists of data elements, such as the current date and time, the vehicle's Vehicle Identification Number, the vehicle's current location, the vehicle's current operational status (i.e., the direction and speed of travel, whether the engine is running or not, the current reading of the odometer, engine operating parameters and diagnostic codes, the locked/unlocked state of the door locks, etc.). Also, this information can consist of data elements describing the occupants of the vehicle such as their number, their location within the vehicle, estimates of height and weight, etc.

Also as known, typically the user bus supports various user systems, such as a cell phone, a radio frequency ("RF") data device, a pager, entertainment system, a global positioning satellite ("GPS") receiver, etc. Also, typically the user bus supports one or more user control units. Similar to the vehicle subsystems, such user control units generate or store user information pertinent to the vehicle or its occupants.

As known, from time to time there is a need for persons or entities physically located off the vehicle to gain access the vehicle system information and the user information from their remote locations. For example, periodically it might be necessary to query a delivery vehicle for its current location to provide an estimated time of arrival at a future pickup or delivery site. Likewise, it might be necessary to assist lost or stranded motorists by determining the location to which to send aid and the type of assistance required. It might also be necessary to inform search and rescue personnel of the number of occupants to expect in a disabled vehicle.

Due to the safety-related and confidential nature of the vehicle and user systems and the confidentiality and privacy of the vehicle's occupants, it is desirable that access to the vehicle system information and user information be limited to authorized persons or entities.

As a result, there is a need for a method for remotely accessing vehicle system information and user information in a vehicle in a secure manner.

BRIEF DESCRIPTION OF THE DRAWINGS

FIG. 5 is a flow diagram for a method for an application to receive vehicle system information, in accordance with the present invention.

DESCRIPTION OF THE PREFERRED EMBODIMENTS

Figure 1:
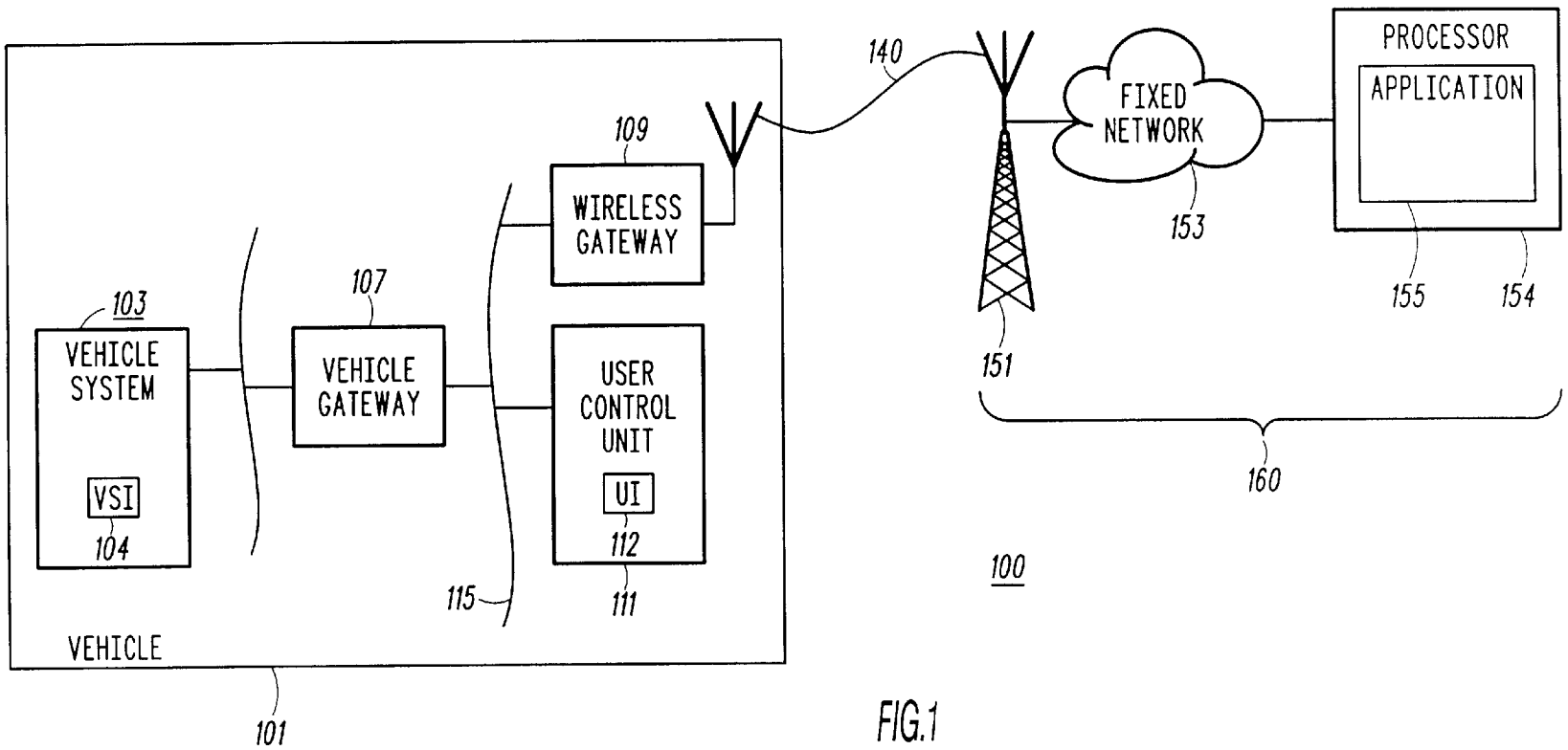
FIG. 1 is a block diagram of a first embodiment of a vehicle 101 and infrastructure that may be used to demonstrate a method for remotely accessing vehicle system information and user information in a vehicle, in accordance with the present invention.

FIG. 1 is a block diagram of a first embodiment of a vehicle 101 and infrastructure that may be used to demonstrate a method for remotely accessing vehicle system information and user information in a vehicle, in accordance with the present invention.

There is shown a communication system 100 having an infrastructure 160 and at least one vehicle 101, the at least one vehicle including a vehicle system 103, a vehicle gateway 107, a wireless gateway 109 and a user control unit 111. In turn, the user control unit includes user information 112. As shown, the vehicle system 103 includes a vehicle system information 104. The vehicle system 103 is coupled to the vehicle gateway by means of a vehicle bus 105. As well, the wireless gateway 109 and the user control unit 111 are coupled to the vehicle gateway by means of a user bus 115. As shown, the infrastructure 160 includes a base station 151, a fixed network 153 and a processor 154. In turn, the processor 154 includes an application 155. Further, the wireless gateway 109 is arranged to communicate with the base station 151 by means of a radio frequency (RF) link 140. In one embodiment, the vehicle 101 comprises a plurality of vehicle systems 103 such as, for example, an engine, braking system, transmission system, and the like.

Figure 2:
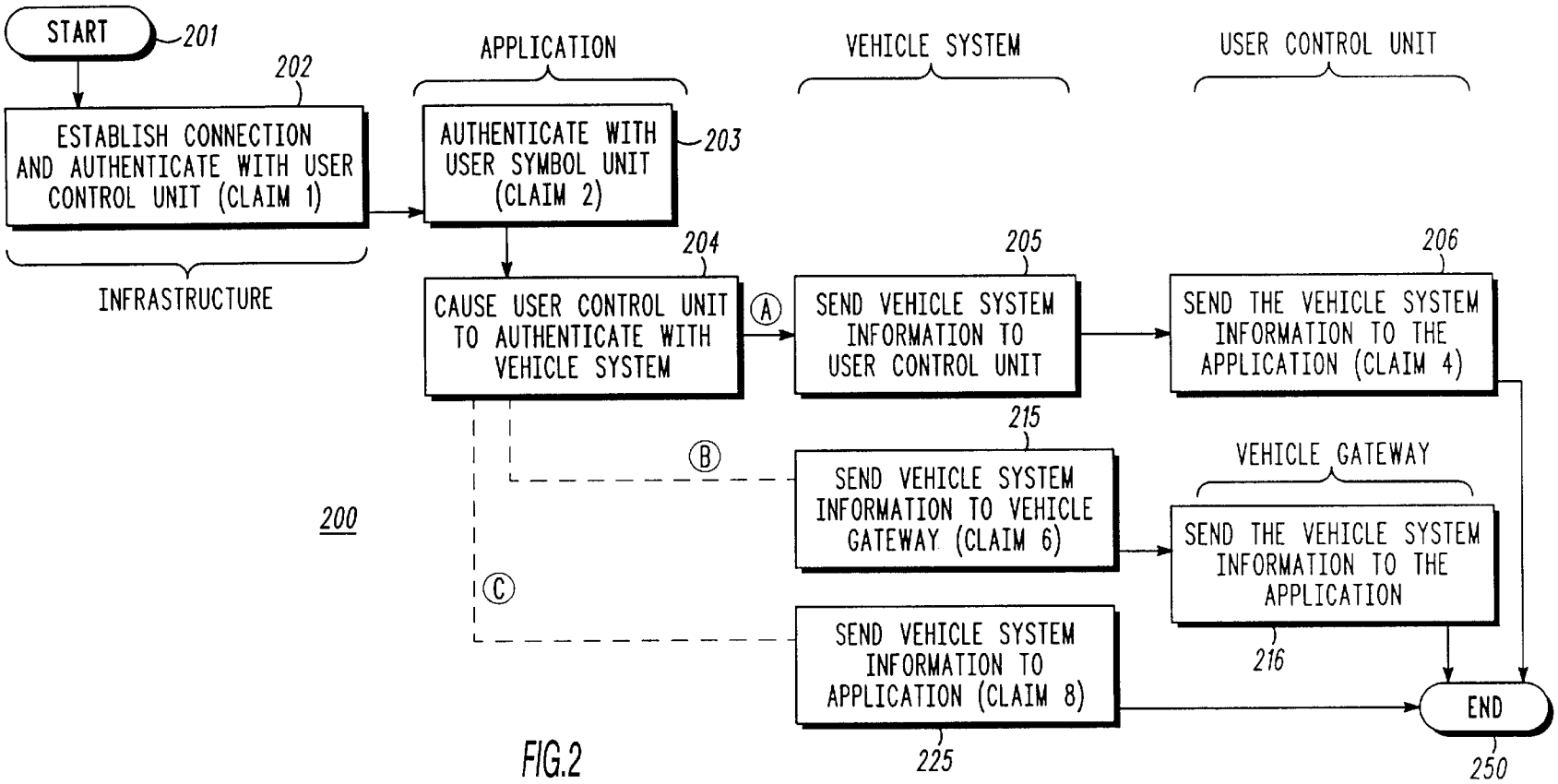
FIG. 2 is a flow diagram for a first embodiment of a method for an application to obtain vehicle system information, in accordance with the present invention.

FIG. 2 depicts a flow diagram 200 for a first embodiment of a method for the application 155 to obtain the vehicle system information 104, in accordance with the present invention. As shown in FIG. 2, step 202 is performed by the infrastructure; steps 203–204 are performed by the application; steps 205, 215 and 225 are performed by the vehicle system; and steps 206 and 216 are performed by the user control unit.

The process starts, step 201, and then goes to step 202. In step 202, the infrastructure establishes a connection with the wireless gateway 109, then establishes a routable authenticated connection with the wireless gateway, and then authenticates itself with the user control unit 111. The process then goes to step 203.

In step 203, the application authenticates itself with the user control unit 111. The process then goes to step 204.

In step 204, the application causes the user control unit 111 to be authenticated with the vehicle system 103 by means of the vehicle gateway.

As shown, after step 204, there are three (3) options for the method to proceed to the next step. In a first option (labeled in FIG. 2 as path A), the process goes to step 205.

In a second option (labeled as path B), the process goes to step 215. In a third option (labeled as path C), the process goes to step 225. Each of these three (3) options now will be discussed.

In the first option (path A), after step 204 the process goes to step 205. In step 205, the vehicle system sends the vehicle system information to the user control unit. The process then goes to step 206.

In step 206, the user control unit sends the vehicle system information to the application.

The process then ends, step 250.

In the second option (path B), after step 204 the process goes to step 215. In step 215, the vehicle system sends the vehicle system information to the vehicle gateway. The process then goes to step 216.

In step 216, the vehicle gateway sends the vehicle system information to the application.

The process then ends, step 250.

In the third option (path C), after step 204 the process goes to step 225. In step 225 the vehicle system sends the vehicle system information to the application.

The process then ends, step 250.

In one embodiment of FIG. 2, the vehicle system information includes at least one of a current date, a current time, a current location of the at least one vehicle, a current mileage of the at least one vehicle, a vehicle identification number, an engine diagnostic code and a general vehicle operating parameter such as coolant temperature, transmission gear, oil pressure and the like.

Figure 3:
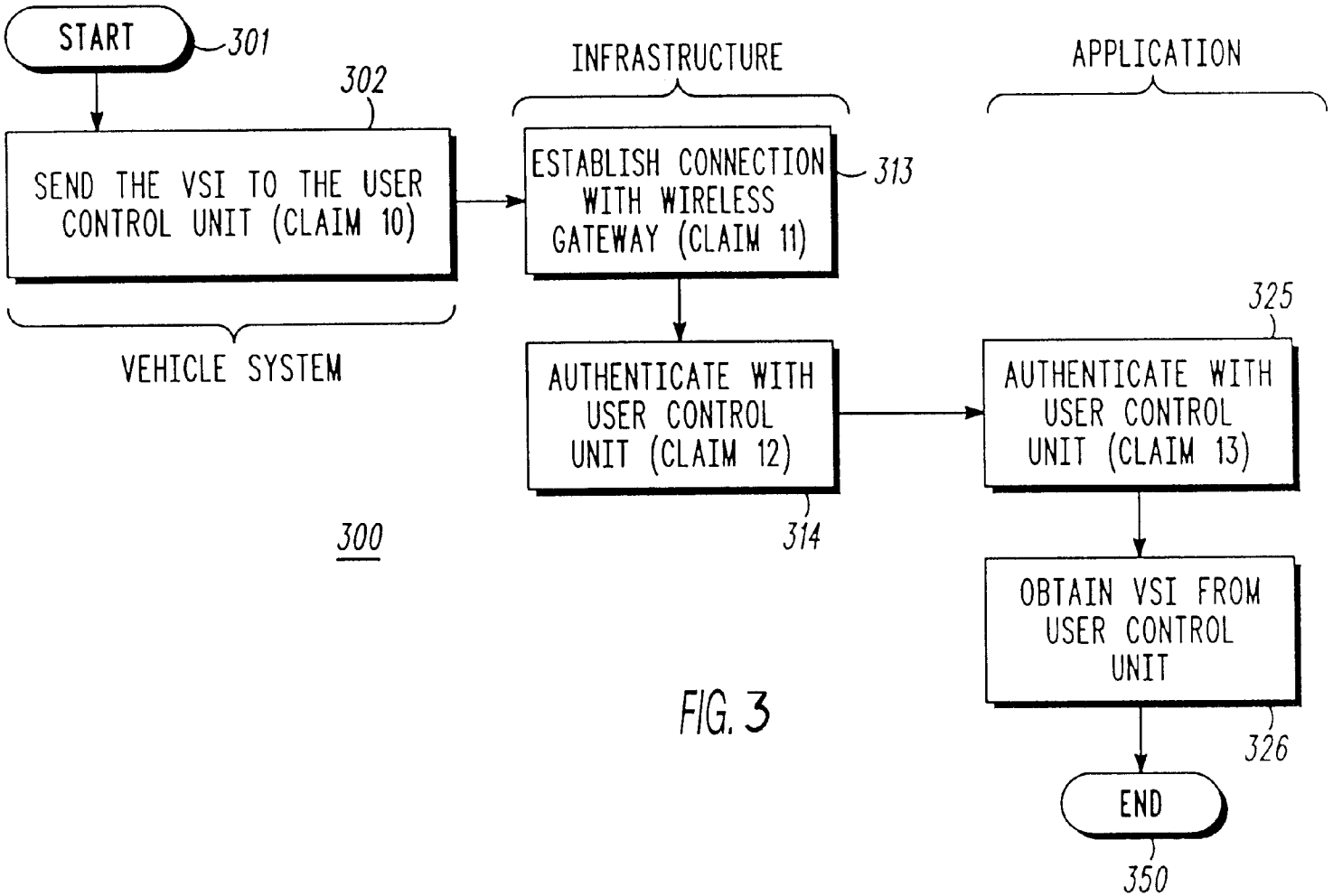
FIG. 3 is a flow diagram for a second embodiment of a method for an application to obtain vehicle system information, in accordance with the present invention.

FIG. 3 depicts a flow diagram 300 for a second embodiment of a method for an application to obtain vehicle system information, in accordance with the present invention. As shown in FIG. 3, step 302 is performed by the vehicle system; steps 313 and 314 are performed by the infrastructure; and steps 325 and 326 are performed by the application.

The process starts, step 301, and then goes to step 302.

In step 302, the vehicle system sends the vehicle system information to the user control unit. The process then goes to step 313.

In step 313, the infrastructure establishes a connection with the wireless gateway, and then establishes a routable authenticated connection with the wireless gateway. The process then goes to step 314.

In step 314, the infrastructure authenticates itself with the user control unit. The process then goes to step 325.

In step 325, the application authenticates itself with the user control unit. The process then goes to step 326.

In step 326, the application obtains the vehicle system information stored in the user control unit.

The process then ends, step 350.

In one embodiment of FIG. 3, the vehicle system information includes at least one of a current date, a current time, a current location of the at least one vehicle, a current mileage of the at least one vehicle, a vehicle identification number, an engine diagnostic code and a general vehicle operating parameter such as coolant temperature, transmission gear, oil pressure and the like.

Figure 4:
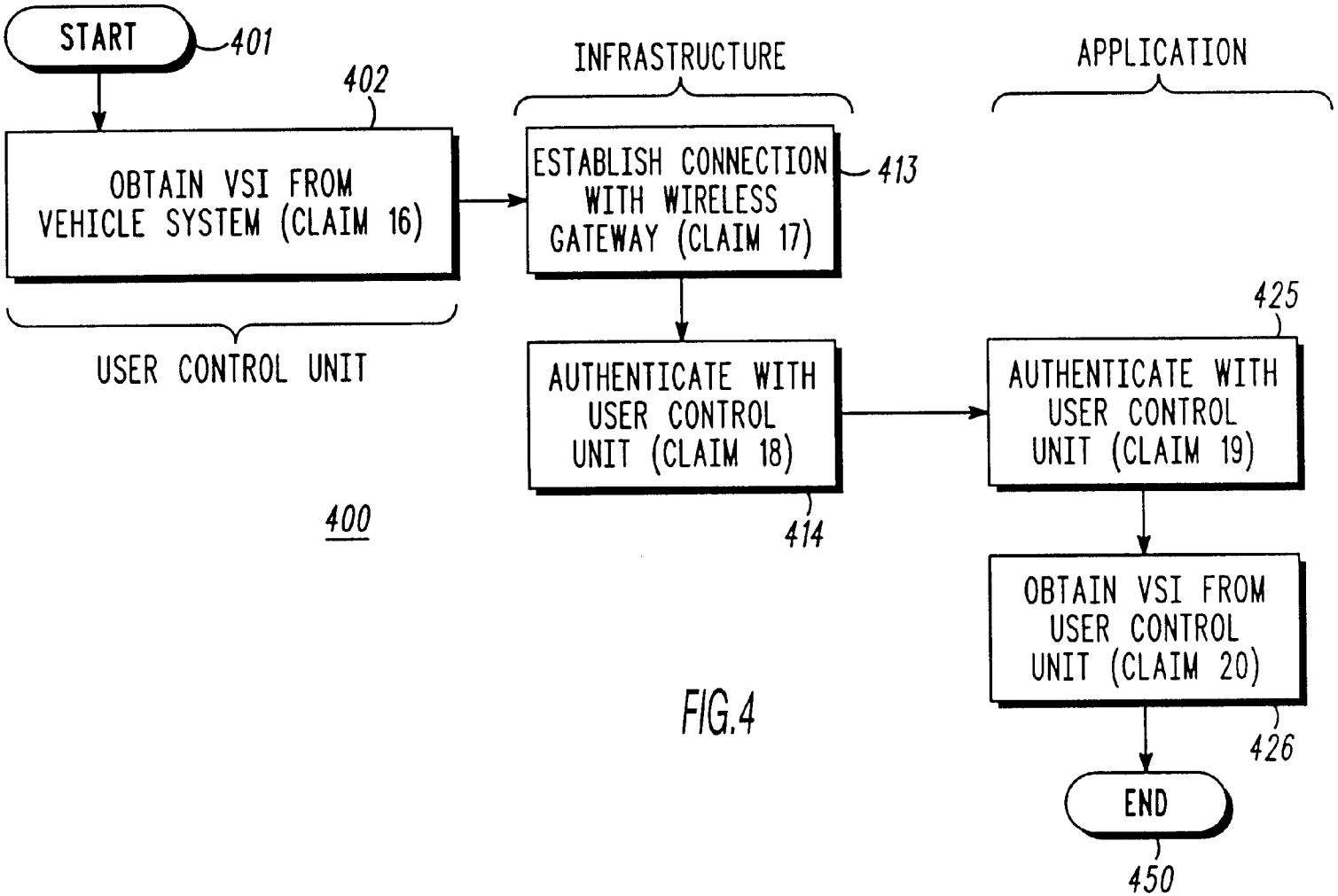
FIG. 4 is a flow diagram for a third embodiment of a method for an application to obtain vehicle system information, in accordance with the present invention.

FIG. 4 depicts a flow diagram 400 for a third embodiment of a method for an application to obtain vehicle system information, in accordance with the present invention. As shown in FIG. 4, step 402 is performed by the user control unit; steps 413–414 are performed by the infrastructure; and steps 425–426 are performed by the application.

The process starts, step 401, and then goes to step 402.

In step 402, the user control unit obtains the vehicle system information from the vehicle system. The process then goes to step 413.

In step 413, the infrastructure establishes a connection with the wireless gateway, and then establishes a routable authenticated connection with the wireless gateway. The process then goes to step 414.

In step 414, the infrastructure authenticates itself with the user control unit. The process then goes to step 425.

In step 425, the application authenticates itself with the user control unit. The process then goes to step 426.

In step 426, the application obtains the vehicle system information stored in the user control unit.

The process then ends, step 450.

In one embodiment of FIG. 4, the vehicle system information includes at least one of a current date, a current time, a current location of the at least one vehicle, a current mileage of the at least one vehicle, a vehicle identification number, an engine diagnostic code and a general vehicle operating parameter such as coolant temperature, transmission gear, oil pressure and the like.

FIG. 5 depicts a flow diagram 500 for a method for an application to receive vehicle system information, in accordance with the present invention. As shown in FIG. 5, step 502 is performed by the vehicle system; steps 503 and 537 are performed by the user control unit; step 514 is performed by the wireless gateway; steps 525–526 are performed by the infrastructure; and step 548 is performed by the application.

The process starts, step 501, and then goes to step 502.

In step 502, the vehicle system sends the vehicle system information to the user control unit. The process then goes to step 503.

In step 503, the user control unit instructs the wireless gateway to establish a connection with the infrastructure. The process then goes to step 514.

In step 514, the wireless gateway establishes a connection with the infrastructure. The process then goes to step 525.

In step 525, the infrastructure establishes a routable, authenticated connection with the wireless gateway. The process then goes to step 526.

In step 526, the infrastructure authenticates the user control unit with the infrastructure. The process then goes to step 537.

In step 537, the user control unit authenticates itself with the application. The process then goes to step 548.

In step 548, the application receives the vehicle system information from the user control unit.

The process then ends, step 550.

In one embodiment of FIG. 5, the vehicle system information includes at least one of a current date, a current time, a current location of the at least one vehicle, a current mileage of the at least one vehicle, a vehicle identification number, an engine diagnostic code and a general vehicle operating parameter such as coolant temperature, transmission gear, oil pressure and the like.

Figure 6:
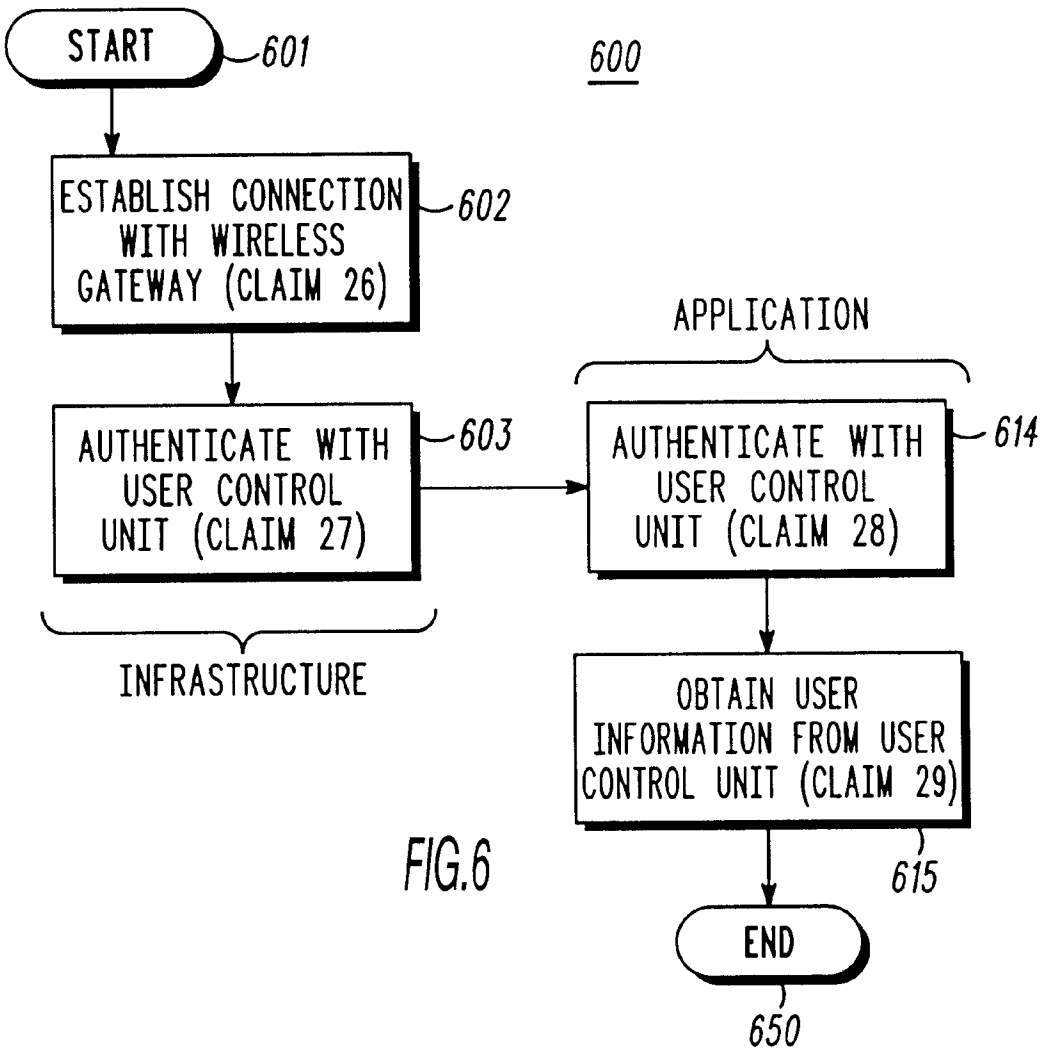
FIG. 6 is a flow diagram for a method for an application to obtain user information, in accordance with the present invention.

FIG. 6 depicts a flow diagram 600 for a method for an application to obtain user information, in accordance with the present invention. As shown in FIG. 6, steps 602–603 are performed by the infrastructure, and steps 614–615 are performed by the application.

The process starts, step 601, and then goes to step 602.

In step 602, the infrastructure establishes a connection with the wireless gateway, and then establishes a routable authenticated connection with the wireless gateway. The process then goes to step 603.

In step 603, the infrastructure authenticates itself with the user control unit. The process then goes to step 614.

In step 614, the application authenticates itself with the user control unit. The process then goes to step 615.

In step 615, the application obtains the user information contained in the user control unit.

In one embodiment of FIG. 6, the user information includes at least one of a current date, a current time, a current location of the at least one vehicle, a current mileage of the at least one vehicle, a vehicle identification number, an engine diagnostic code and a general vehicle operating parameter such as coolant temperature, transmission gear, oil pressure and the like.

The advantages of the present invention are now discussed.

Previous attempts to provide similar functionality have either operated in an unsecured or relatively poorly secured manner or required the active, real-time participation of humans both at the vehicle and at a central service desk located somewhere else. Usually, a cellular phone call is placed to or from the vehicle and a limited amount of specific, predefined data is "piggybacked" onto the voice call. That is, the data is transmitted in a secondary non-voice channel or between voice blocks on the voice channel or the voice call is momentarily muted while the vehicle data is transmitted over the voice channel itself.

The present invention uses a data path that:

does not interfere with or interrupt or even require a voice call, thus leaving the cellular handset available to place and receive voice calls;

allows more secure unattended operation of automated systems on the vehicle and at the service center;

provides increased security measures and safeguards;

permits more data to be exchanged with the vehicle both in terms of the quantity and the type of data exchanged; and provides increased flexibility for adding to or upgrading the data capabilities of the vehicle, post-manufacture.

The present invention improves ease-of-use for both vehicle occupants and service center personnel since the network systems can automatically request, receive, manipulate, and react to vehicle system and user data on behalf of the human operators without requiring explicit human interaction.

In addition to ease-of-use, unattended operation also has other benefits such as lower cost to provide services since common routine tasks can be performed without a human operator in direct participation. Complex tasks may be merely supervised by human operators and controlled by simple, ease to learn interfaces that do not require highly trained experts to perform.

Improved security both better protects the information currently available in the vehicle and also allows more information to be provided since access to the data may be tightly controlled on a data element by data element basis if necessary. Since more data may be safely collected and made available for access, additional services may be designed and implemented, providing greater value to vehicle owners and occupants.

With the definition of a standard security and access system, the present invention also enables service providers to define and implement new services more quickly and with less effort and cost than currently possible. The improved security of the end-to-end authenticated connections created by the present invention provides service providers with means for reliable user authentication and the ability to tabulate non-refutable charges enabling them to define business cases for collecting revenue for value-added services consumed by their users. The present invention allows the design and implementation of additional vehicle and user systems which have not been traditionally installed in vehicles.

We claim:

1. In a communication system having an infrastructure and at least one vehicle, the at least one vehicle including a vehicle system, a vehicle gateway, a wireless gateway and a user control unit, the vehicle system including a vehicle system information, the vehicle system coupled to the vehicle gateway, the wireless gateway coupled to the vehicle gateway, the user control unit coupled to the vehicle gateway, the infrastructure including an application, a method for the application to obtain the vehicle system information comprising the steps of:

(a) by the infrastructure, establishing a connection with the wireless gateway;

(b) by the infrastructure, establishing a routable authenticated connection with the wireless gateway;

(c) by the infrastructure, authenticating itself with the user control unit;

(d) by the application, authenticating itself with the user control unit; and (e) by the application, causing the user control unit to be authenticated with the vehicle system by means of the vehicle gateway.

2. The method of claim 1, the vehicle system including a vehicle system information and including the steps of:

(f) by the vehicle system, sending the vehicle system information to the user control unit; and (g) by the user control unit, sending the vehicle system information to the application.

3. The method of claim 2, where the vehicle system information includes at least one of a current date, a current time, a current location of the at least one vehicle, a current mileage of the at least one vehicle, a vehicle identification number, an engine diagnostic code and a general vehicle operating parameter such as coolant temperature, transmission gear, oil pressure and the like.

4. The method of claim 1, the vehicle system including a vehicle system information and including the steps of:

(f) by the vehicle system, sending the vehicle system information to the vehicle gateway; and (g) by the vehicle gateway, sending the vehicle system information to the application.

5. The method of claim 4, where the vehicle system information includes at least one of a current date, a current time, a current location of the at least one vehicle, a current mileage of the at least one vehicle, a vehicle identification number, an engine diagnostic code and a general vehicle operating parameter such as coolant temperature, transmission gear, oil pressure and the like.

6. The method of claim 1, the vehicle system including a vehicle system information and including a step of:

(f) by the vehicle system, sending the vehicle system information to the application.

7. The method of claim 6, where the vehicle system information includes at least one of a current date, a current nine, a current location of the at least one vehicle, a current mileage of the at least one vehicle, a vehicle identification number, an engine diagnostic code and a general vehicle operating parameter such as coolant temperature, transmission gear, oil pressure and the like.

8. In a communication system having an infrastructure and at least one vehicle, the at least one vehicle including a vehicle system, a vehicle gateway, a wireless gateway and a user control unit, the vehicle system including a vehicle system information, the vehicle system coupled to the vehicle gateway, the wireless gateway coupled to the vehicle gateway, the user control unit coupled to the vehicle gateway, the infrastructure including an application, a method for the application to obtain the vehicle system information comprising the steps of:

(a) by the vehicle system, sending the vehicle system information to the user control unit;

(b) by the infrastructure, establishing a connection with the wireless gateway;

(c) by the infrastructure, establishing a routable authenticated connection with the wireless gateway;

(d) byte infrastructure, authenticating itself with the user control unit;

(e) by the application, authenticating itself with the user control unit; and (f) by the application, causing the user control unit to be authenticated with the vehicle system by means of the vehicle gateway.

9. The method of claim 8, including a step of:

(g) by the application, obtaining the vehicle system information stored in the user control unit.

10. The method of claim 9, where the vehicle system information includes at least one of a current date, a current time, a current location of the at least one vehicle, a current mileage of the at least one vehicle, a vehicle identification number, an engine diagnostic code and a general vehicle operating parameter such as coolant temperature, transmission gear, oil pressure and the like.

11. In a communication system having an infrastructure and at least one vehicle, the at least one vehicle including a vehicle system, a vehicle gateway, a wireless gateway and a user control unit, the vehicle system including a vehicle system information, the vehicle system coupled to the vehicle gateway, the wireless gateway coupled to the vehicle gateway, the user control unit coupled to the vehicle gateway, the infrastructure including an application, a method for the application to obtain the vehicle system information comprising the steps of:

(a) by the user control unit, obtaining the vehicle system information from the vehicle system;

(b) by the infrastructure, establishing a connection with the wireless gateway;

(c) by the infrastructure, establishing a routable authenticated connection with the wireless gateway;

(d) by the infrastructure, authenticating itself with the user control unit;

(e) by the application, authenticating itself with the user control unit; and (f) by the application, causing the user control unit to be authenticated with the vehicle system by means of the vehicle gateway.

12. The method of claim 11, including a step of:

(g) by the application, obtaining the vehicle system information stored in the user control unit.

13. The method of claim 12, where the vehicle system information includes at least one of a current date, a current time, a current location of the at least one vehicle, a current mileage of the at least one vehicle, a vehicle identification number, an engine diagnostic code and a general vehicle operating parameter such as coolant temperature, transmission gear, oil pressure and the like.

14. In a communication system having an infrastructure and at least one vehicle, the at least one vehicle including a vehicle system, a vehicle gateway, a wireless gateway and a user control unit, the vehicle system including a vehicle system information, the vehicle system coupled to the vehicle gateway, the wireless gateway coupled to the vehicle gateway, the user control unit coupled to the vehicle gateway, the infrastructure including an application, a method for the application to receive the vehicle system information comprising the steps of:

(a) by the vehicle system, sending the vehicle system information to the user control unit;

(b) by the user control unit, instructing the wireless gateway to establish a connection with the infrastructure;

(c) by the wireless gateway, establishing a connection with the infrastructure;

(d) by the infrastructure, establishing a routable, authenticated connection with the wireless gateway;

(e) by the infrastructure, authenticating the user control unit with the infrastructure;

(f) by the user control unit, authenticating itself with the application; and (g) by the application, causing the user control unit to be authenticated with the vehicle system by means of the vehicle gateway.

15. The method of claim 14, including a step of:

(h) by the application, receiving the vehicle system information from the user control unit.

16. The method of claim 15, where the vehicle system information includes at least one of a current date, a current time, a current location of the at least one vehicle, a current mileage of the at least one vehicle, a vehicle identification number, an engine diagnostic code and a general vehicle operating parameter such as coolant temperature, transmission gear, oil pressure and the like.

17. In a communication system having an infrastructure and at least one vehicle, the at least one vehicle including a wireless gateway and a user control unit, the user control unit coupled to the wireless gateway, the user control unit containing user information, the infrastructure including an application, a method for the application to obtain the user information comprising the steps of:

(a) by the infrastructure, establishing a connection with the wireless gateway, and (b) by the infrastructure, establishing a mutable authenticated connection with the wireless gateway;

(c) by the infrastructure, authenticating itself with the user control unit;

(d) by the application, authenticating itself with the user control unit; and (e) by the application, causing the user control unit to be authenticated with the vehicle system by means of the vehicle gateway.

18. The method of claim 17, including a step of:

(f) by the application, obtaining the user information contained in the user control unit.

19. The method of claim 18, where the user information includes at least one of a current date, a current time, a current location of the at least one vehicle, a current mileage of the at least one vehicle, a vehicle identification number, an engine diagnostic code and a general vehicle operating parameter such as coolant temperature, transmission gear, oil pressure and the like.

* * * * *

UNITED STATES PATENT AND TRADEMARK OFFICE

CERTIFICATE OF CORRECTION

PATENT NO. : 6,765,497 B2
DATED : July 20, 2004
INVENTOR(S) : Ablay et al.

It is certified that error appears in the above-identified patent and that said Letters Patent is hereby corrected as shown below:

Column 7,
Line 26, reads "(d) byte infrastructure," should read -- (d) by the infrastructure, --

Signed and Sealed this

Seventh Day of September, 2004

JON W. DUDAS
*Director of the United States Patent and Trademark Office*